US005697020A

United States Patent [19]

Sato et al.

[11] Patent Number: 5,697,020

[45] Date of Patent: Dec. 9, 1997

[54] IMAGE FORMING APPARATUS FOR MOVING A CHARGING ROLLER TOWARDS AND AWAY FROM A PHOTORECEPTOR AND A CLEANING MEMBER FOR THE CHARGING ROLLER

[75] Inventors: Mitsuru Sato, Matsudo; Akio Kutsuwada, Kawasaki; Takeshi Saito, Tokyo; Toshitaka Yamaguchi, Ohmiya, all of Japan

[73] Assignee: Ricoh Company, Ltd., Tokyo, Japan

[21] Appl. No.: 588,304

[22] Filed: Jan. 18, 1996

[30] Foreign Application Priority Data

| | | | |
|---|---|---|---|
| Jan. 20, 1995 | [JP] | Japan | 7-007225 |
| Feb. 23, 1995 | [JP] | Japan | 7-035465 |
| Dec. 13, 1995 | [JP] | Japan | 7-324715 |

[51] Int. Cl.[6] ..... G03G 15/02

[52] U.S. Cl. ..... 399/100; 361/225; 399/99

[58] Field of Search ..... 355/219, 200, 355/211; 361/225; 399/98, 99, 100

[56] References Cited

U.S. PATENT DOCUMENTS

| | | | |
|---|---|---|---|
| 4,339,195 | 7/1982 | Gabelman | 355/219 |
| 5,552,865 | 9/1996 | Owasa et al. | 355/219 |

FOREIGN PATENT DOCUMENTS

| | | |
|---|---|---|
| 5-188738 | 7/1993 | Japan . |
| 6-3930 | 1/1994 | Japan . |
| 7-199603 | 8/1995 | Japan . |

*Primary Examiner*—Arthur T. Grimley
*Assistant Examiner*—Quana Grainger
*Attorney, Agent, or Firm*—Oblon, Spivak, McClelland, Maier & Neustadt, P.C.

[57] ABSTRACT

An image forming apparatus having a device for moving a charging roller towards and away from a photoreceptor and a cleaning member for the charging roller. The charging roller moving device moves the charging roller to positions including a first position where the charging roller is in contact with the photoreceptor and is separated from the cleaning member for a charging operation, a second position where the charging roller is in contact with the cleaning member for cleaning the surface of the charging roller and a third position where the charging roller is separated from the photoreceptor and the cleaning member. Even if the apparatus is left unoperated for a long time, the photoreceptor is prevented from being contaminated by the charging roller by placing the charging roller in the third position.

16 Claims, 7 Drawing Sheets

IMAGE FORMING APPARATUS FOR MOVING A CHARGING ROLLER TOWARDS AND AWAY FROM A PHOTORECEPTOR AND A CLEANING MEMBER FOR THE CHARGING ROLLER

BACKGROUND OF THE INVENTION

2. Field of the Invention

The present invention relates to an image forming apparatus using an electrophotography, such as a copying machine, a printer, a facsimile machine or the like, which includes a charging roller and a cleaning member for cleaning the surface of the charging roller, and more particularly to a device for moving the charging roller towards and away from a photoreceptor and the cleaning member for the charging roller.

2. Discussion of the Background

There is known, as an example, an image forming apparatus which includes a charging roller, which is movable towards and away from a photoreceptor, and a cleaning member for cleaning the surface of the charging roller, which is described in Japanese Published Unexamined Patent Application Tokukaihei 5-333670.

The image forming apparatus described in the above-mentioned application includes a cartridge which is detachable from a main body of the apparatus and includes integrally therein a photoreceptor, a charging roller which charges the surface of the photoreceptor, a developing unit and a cleaning unit for cleaning the surface of the photoreceptor. A metal shaft of the charging roller is supported by a frame of the cartridge in such a way that the charging roller is movable toward and away from the surface of the photoreceptor. When the cartridge is mounted in a prescribed position of the main body of the apparatus, a bearing which supports the conductive metal shaft of the charging roller contacts one end of a pressure spring, whose other end is fixed to a spring mounting seat which is formed on the main body of the apparatus in a position corresponding to the charging roller. This thereby presses the charging roller towards the photoreceptor to contact the surface of the photoreceptor, thus enabling the charging roller to be rotated coupled with the photoreceptor. When the cartridge is detached from the apparatus, the pressuring spring is separated from the bearing which supports the charging roller, and the charging roller contacts the surface of the photoreceptor by its own weight.

Also described in the same application is an image forming apparatus in which, when the cartridge is mounted in a prescribed position of the main body of the apparatus, an elastic member, which is made of a foaming material, such as a polyurethane, and which acts also as a cleaning member for cleaning the surface of the charging roller, contacts the surface of the charging roller and presses the charging roller towards the photoreceptor to contact the surface of the photoreceptor, thus enabling the charging roller to be rotated coupled with the photoreceptor.

There exists a problem in this type of an image forming apparatus, which is caused by the charging roller being always pressed, by the pressuring force of the pressing spring or the elastic force of the cleaning member which is made of an elastic material, towards, and to stay in contact with, the surface of the photoreceptor, when the cartridge is mounted to the main body of the apparatus. Namely, the part of a charging roller which comes in contact with the surface of the photoreceptor is generally made of a conductive rubber, and plastic materials which are contained in the rubber of the charging roller ooze out and contaminate the surface of the photoreceptor which is in contact with the charging roller, when such a condition that the same part of the charging roller is pressed towards and stays in contact with the surface of a photoreceptor continues for a long time, such as when the apparatus is not in an image forming operation. Further, when such a condition continues for a long time in an environment with high temperature and moisture, there exists a possibility that toner which is transferred to the surface of the cleaning member from the surface of the charging roller by a cleaning operation is transferred again back to the surface of the charging roller and fixed thereon.

Further, when an image forming operation is repeated for a long time for a continuous copying, for example, the charging roller continues to be rotated coupled with the photoreceptor during the image forming operation, and therefore there exists a problem that the elastic member, which is pressed towards and in contact with the surface of the charging roller and which acts also as a cleaning member, damages the surface of the charging roller by continuously being in contact therewith, thereby causing nonuniformity in a charge generated on the surface of the photoreceptor.

Further, in a case that a charging roller is rotated coupled with a photoreceptor by a friction force between the charging roller and the photoreceptor and an elastic member which acts also as a cleaning member for the charging roller is pressed towards and in contact with the surface of the charging roller, there exists a problem that a slipping occurs between the charging roller and the photoreceptor due to a load which is given to the charging roller by the cleaning member, thereby lowering a level of a charge generated on the surface of the photoreceptor or a level of cleanliness of the surface of the charging roller.

Further, although the charging roller is released from a pressure from the pressuring spring when the cartridge is detached from the main body of the apparatus, the charging roller is not completely separated from the surface of the photoreceptor and continues to contact the surface of the photoreceptor by its own weight, and therefore, there still exists a possibility that the above-mentioned plastic materials ooze out from the rubber to contaminate the surface of the photoreceptor.

The contamination on the surface of a photoreceptor due to such plastic materials can hardly be seen by the eye, but, when a latent image formed on the photoreceptor is developed, the quantity of toner which adheres to such a part where the plastic materials adhere becomes less compared to other parts. Consequently, when the developed image is transferred to a paper, there appears a white streak in a place corresponding to the contaminated part, thereby making an image reproduced on the paper an irregular one.

SUMMARY OF THE INVENTION

The present invention has been made in view of such problems, and therefore, an object of the present invention is to provide a novel image forming apparatus which eliminates occurrence of a charging roller contaminating the surface of a photoreceptor, which causes an irregular image, such as a white streak, even if an apparatus is left without performing an image forming operation for a long time.

A further object of the present invention is to provide a novel image forming apparatus which eliminates occurrence of the surface of a charging roller being damaged by a cleaning member, even if an image forming operation is performed continuously for a long time.

A further object of the present invention is to provide a novel image forming apparatus which eliminates occurrence of a slipping between a charging roller and a photoreceptor, which causes lowering of a level of a charge generated on the photoreceptor or lowering of a level of cleanliness of the surface of the charging roller.

In order to achieve the above-mentioned objects, an image forming apparatus of the present invention includes a novel device for moving the charging roller towards and away from the photoreceptor and the cleaning member to positions including 1) a first position where the charging roller is separated from the cleaning member and is in contact with the photoreceptor for charging the photoreceptor, 2) a second position where the charging roller is in contact with the cleaning member for cleaning the surface of the charging roller, and 3) a third position where the charging roller is separated from the photoreceptor and the cleaning member.

Further, the charging roller, according to the present invention, may be in contact with the photoreceptor when the charging roller is in the above-mentioned second position.

Further, the charging roller moving device, according to the present invention, may include a structure which enables a movement of the cleaning member towards and away from the charging roller independently from a movement of the charging roller towards and away from the photoreceptor.

Further, the structure for enabling a movement of the cleaning member towards and away from the charging roller independently from a movement of the charging roller towards and away from the photoreceptor, according to the present invention, may include a charging roller support member to which the cleaning member is fixed and with which the charging roller is engaged in a manner movable towards and away from the cleaning member, and a device for moving the charging roller support member towards and away from the photoreceptor.

Further, the above-mentioned device for moving the charging roller support member towards and away from the photoreceptor may include a spring member for pushing the charging roller support member away from the photoreceptor, and a device for pressing the charging roller support member towards the photoreceptor. The device for pressing the charging roller support member towards the photoreceptor may have a pressing force which is stronger than that of the spring member for pushing the charging roller support member away from the photoreceptor and may include a device for placing the charging roller support member to positions including the above-mentioned first, second and third positions.

Further, the above-mentioned device for placing the charging roller support member to positions including the first, second and third positions, according to the present invention, may include a lever member for pressing the charging roller support member towards the photoreceptor, a cam member which is engaged with the lever member and prescribes positions including the above-mentioned first, second and third positions, in which the charging roller support member is placed.

Further, a part of the above-mentioned device for pressing the charging roller support member, which contacts with and presses the charging roller support member, according to the present invention, may be located in a position separated from the charging roller support member when the charging roller support member is located in the third position.

Further, according to the present invention, the photoreceptor may be provided with a gear on each edge and the charging roller may be provided with a gear at a position corresponding to the gear on the photoreceptor, and the gear on the charging roller engages with the gear on the photoreceptor when the charging roller is located in the second position contacting the photoreceptor.

Further, the image forming apparatus according to the present invention may further include a case which houses therein the charging roller support member, together with the photoreceptor or together with a developing unit and a cleaning unit for cleaning the surface of the photoreceptor, and is detachable from the main body of the apparatus. Further, the device for moving the charging roller support member may be mounted to the main body of the apparatus.

As described above, the image forming apparatus according to the present invention provides a device for moving the charging roller to the positions including the first position where the charging roller is in contact with the photoreceptor and separated from the cleaning member, the second position where the charging roller is in contact with the cleaning member and the third position where the charging roller is separated from the photoreceptor and the cleaning member. Therefore, if the charging roller is in the third position, there will not occur such a problem that the charging roller contaminates the surface of the photoreceptor, even if the apparatus is left for a long time without performing an image forming operation, since the charging roller is separated from the photoreceptor. Moreover, since the cleaning member is also separated from the charging roller in the third position, there will not occur such a problem that toner which is transferred to the surface of the cleaning member from the surface of the charging roller is transferred back to the surface of the charging roller and fixed thereon, even if the apparatus is left without performing an image forming operation for a long time in an environment with high temperature and moisture.

Further, since the charging roller is in contact with the photoreceptor, while being separated from the cleaning member, in the first position, there will not occur such a problem, if the charging roller is in the first position, that the cleaning member damages the surface of the charging roller, even if an image forming operation is repeated for a long time for a continuous copying.

Further, the image forming apparatus according to the present invention may provide a structure which enables a movement of the cleaning member towards and away from the charging roller independently from a movement of the charging roller towards and away from the photoreceptor, and such structure provides a charging roller support member to which the cleaning member is fixed and with which the charging roller is engaged in a manner movable towards and away from the cleaning member and a device for moving such a charging roller support member towards and away from the photoreceptor. Therefore, it is possible to move the charging roller towards and away from the photoreceptor and the cleaning member by simply moving the charging roller support member towards and away from the photoreceptor. Moreover, the above-mentioned device for moving the charging roller support member provides a spring member for pushing the charging roller support member away from the photoreceptor and a device for pressing the charging roller support member towards the photoreceptor, which includes a device for placing the charging roller support member to positions including the first, second and third positions. Therefore, it is possible to place the charging roller support member to one of the three positions with a relatively simple structure.

Further, a part of the above-mentioned device for pressing the charging roller support member which contacts with and presses the charging roller support member may be located in a position separated from the charging roller support member when the charging roller support member is located in the third position. Therefore, the charging roller, when in the third position, can be removed easily together with the charging roller support member from the apparatus for maintenance or replacement.

Further, there may be provided a gear on each edge of the photoreceptor and also on the charging roller at a position corresponding to the gear on the photoreceptor, and these gears engage together when the charging roller is located in the second position, so that the photoreceptor is rotated coupled with the charging roller. Therefore, even if the cleaning member is pressed towards and is in contact with the charging roller, there will not occur such a problem that a slipping occurs between the charging roller and the photoreceptor due to a load which is given to the charging roller by the cleaning member.

Further, there may be provided a case which houses therein, together with a photoreceptor or with a developing unit or a cleaning unit, the charging roller support member, to which the cleaning member is fixed and with which the charging roller is engaged in a manner movable towards and away from the cleaning member, and is detachable from the main body of the apparatus. Since the device for moving the charging roller support member towards and away from the photoreceptor is mounted to the main body of the apparatus, such a device for moving the charging roller support member does not have to be replaced even if other parts, such as a charging roller and a cleaning member, which need to be replaced regularly, are replaced integrally in the case, thus saving the cost which will incur in case the device for moving the charging roller support member is mounted in the above-mentioned case.

BRIEF DESCRIPTION OF THE DRAWINGS

A more complete appreciation of the present invention and many of the attendant advantages thereof will be readily obtained as the same becomes better understood by reference to the following detailed description when considered in connection with the accompanying drawings, wherein:

FIG. 11(*b*) is a schematic drawing illustrating a state where the charging roller is in contact with the photoreceptor in the second embodiment; and FIG. 11(*c*) is a schematic drawing illustrating a state where the charging roller is separated from the photoreceptor and is in contact with the cleaning member for the charging roller in the second embodiment.

DESCRIPTION OF THE PREFERRED EMBODIMENTS

Figure 1:
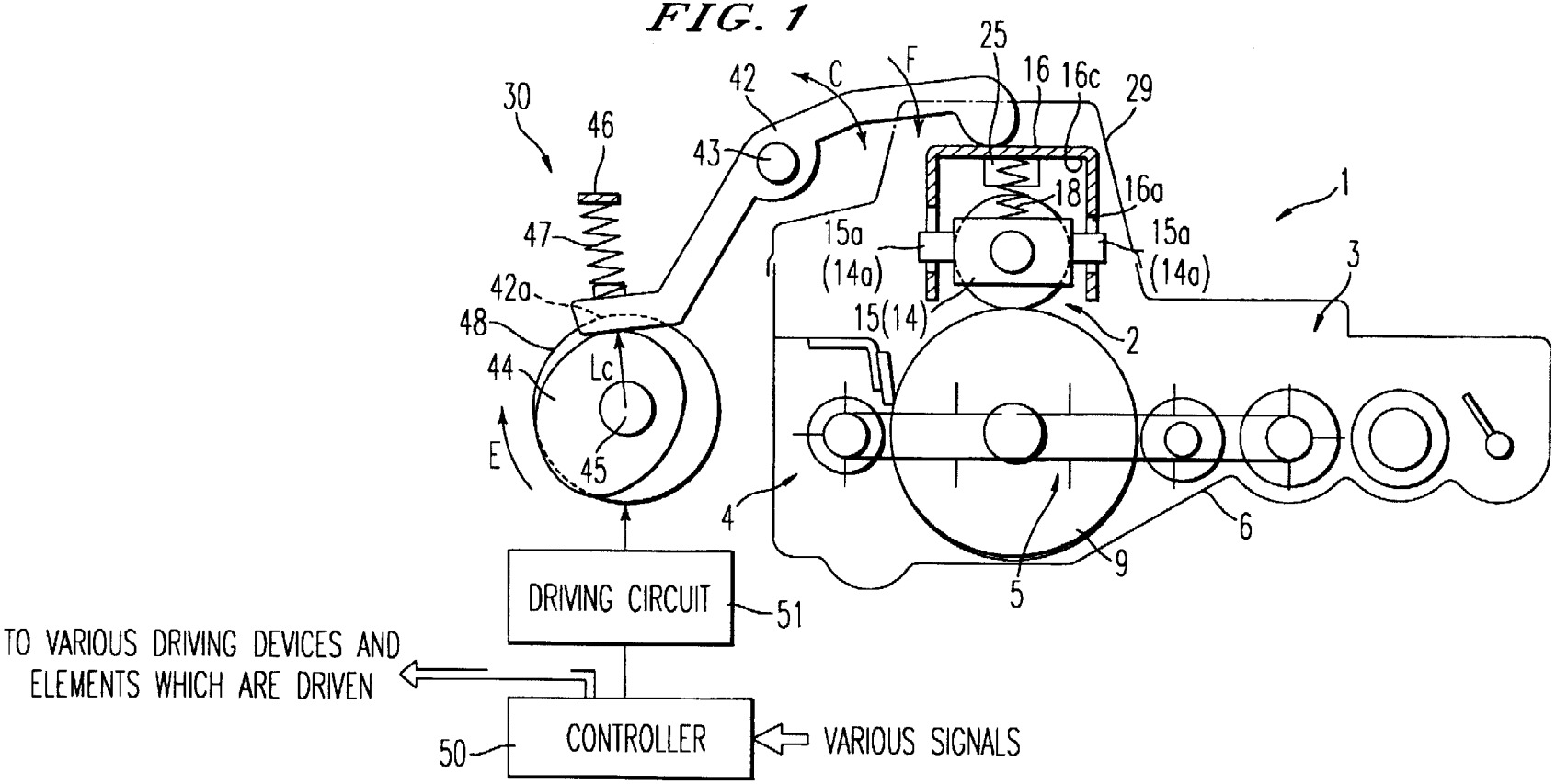
FIG. 1 is a schematic drawing illustrating an image forming part and a control part of an image forming apparatus, according to the present invention, and further a state where a charging roller is in contact with a photoreceptor and is separated from a cleaning member for the charging roller.

Referring now to the drawings, wherein like reference numerals designate identical or corresponding parts throughout the several views, embodiments of the present invention are explained.

Figure 2:
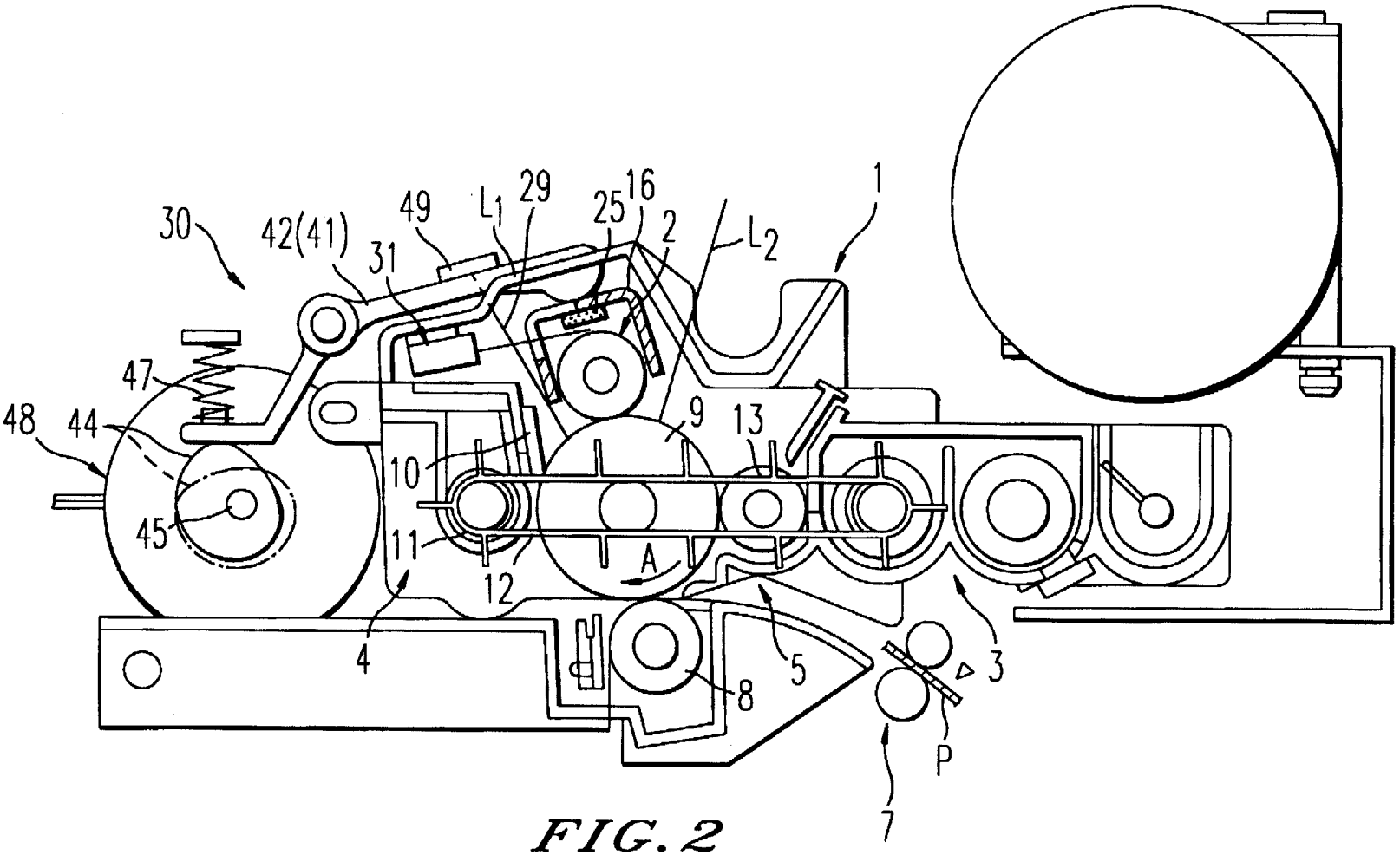
FIG. 2 is a schematic drawing illustrating in more detail the image forming part of the apparatus.

FIG. 1 is a schematic drawing illustrating an image forming part and a control part of an image forming apparatus according to the present invention, and FIG. 2 is a schematic drawing illustrating in more detail the image forming part of the apparatus.

The image forming part of the apparatus is constructed, as illustrated in FIG. 1, as an image forming unit 1 in a form of a cartridge which is detachable from a main body of the apparatus, which is not illustrated in the drawing.

The image forming unit 1 includes an image forming unit case 6 in which a photoreceptor 9, a charging roller 2, a developing unit 3, a cleaning unit 4 and a recycled toner delivery unit 5, which delivers toner which is recovered from the cleaning unit 4 to the developing unit 3, are included in such a way that these units are detachable from the main body of the apparatus as an integrated unit.

The photoreceptor 9 is rotatable in the direction indicated by an arrow A when the image forming unit 1 is mounted at a prescribed position of the apparatus as shown in FIG. 2.

When an image forming operation is commenced with this image forming apparatus, the surface of the photoreceptor 9 is discharged by discharge light L1 from a discharge lamp 4 and an electric potential (electrostatic charge) over the surface of the photoreceptor 9 is made uniformly to a base level of 0—150V.

Then, the photoreceptor 9 is charged by applying electricity with high voltage to the charging roller 2 which is in contact with the surface of the photoreceptor 9 to make the surface electric potential to around −1100V. Then, the charged surface is exposed by exposure light L2 from an exposure unit to form a latent image part which has a surface electric potential of 0—290V and becomes later a toner image.

When the photoreceptor 9 rotates in the direction indicated by an arrow A and the latent image part reaches a development sleeve 13 of the developing unit 3, toner which is held on the surface of the development sleeve 13 to which a bias voltage of around −800V is applied is transferred to the latent image part, developing the latent image part to form a toner image.

On the other hand, a transfer paper P is fed from a paper feeding unit (not illustrated in the drawing) and a leading edge of the paper P is registered, by a pair of registering rollers 7, with a leading edge of the toner image on the photoreceptor 9 when the paper P reaches a transfer roller 8, and the toner image on the photoreceptor 9 is transferred to the paper P by the transfer roller 8.

The transfer paper P is then fed in between a pair of rollers in a fixing unit (not illustrated in the drawing), wherein the toner image is melted and fixed to the paper P, and then the paper P is output to a paper exit tray which is provided outside of the apparatus.

A residual toner which still remains on the surface of the photoreceptor 9 after the transfer process is scraped off by a cleaning blade 10 of the cleaning unit 4, and the photoreceptor 9, with the surface almost free from the toner, moves to the next image forming step.

The residual toner which is recovered by the cleaning unit 4 is delivered by a toner delivery coil 11 to a recycled toner delivery unit 5 and then to a developer mixing unit of the developing unit 3 to be recycled.

Figure 3:
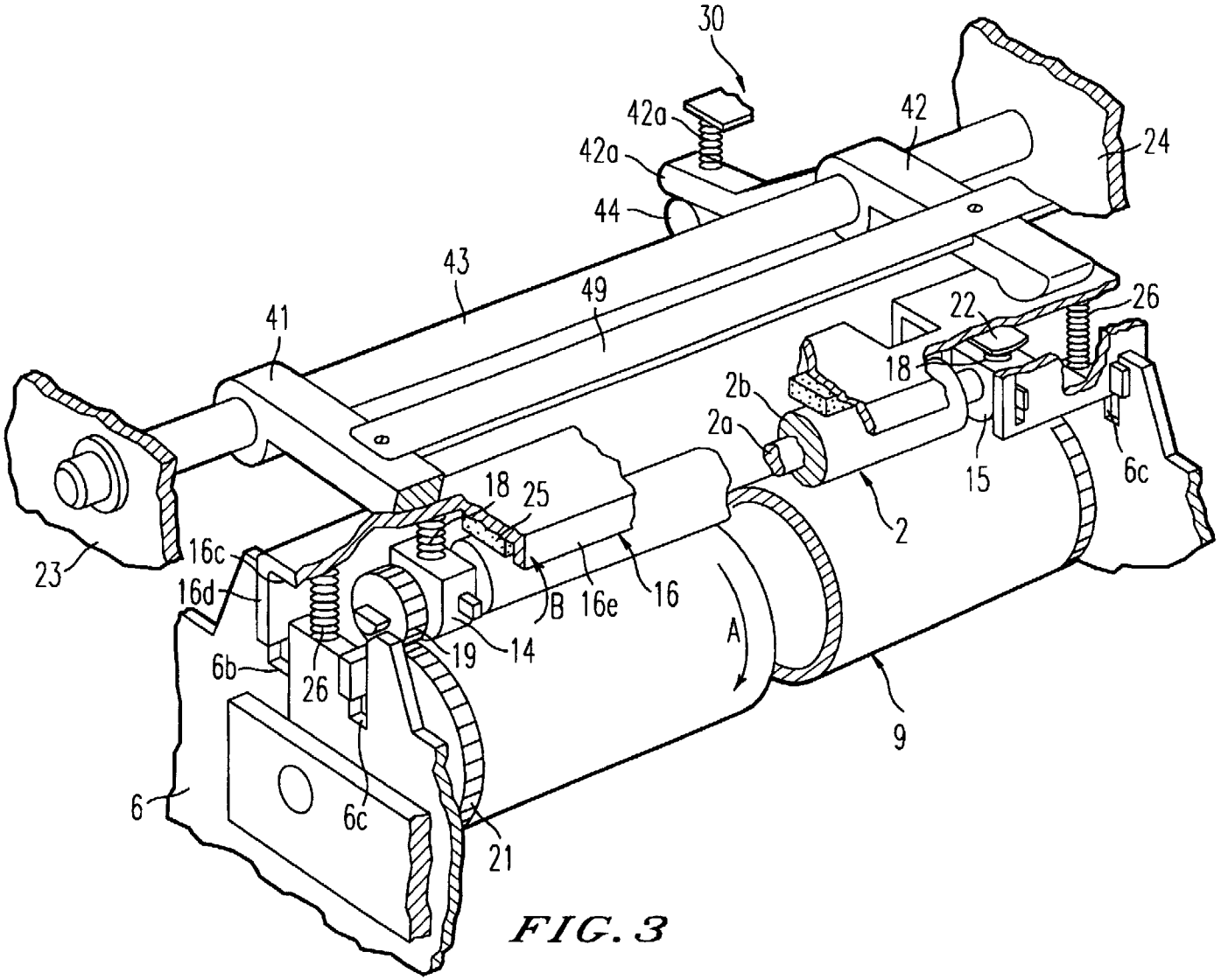
FIG. 3 is a perspective drawing illustrating a charging roller and the periphery thereof, including a photoreceptor, which are provided in the image forming part of the apparatus.
Figure 4:
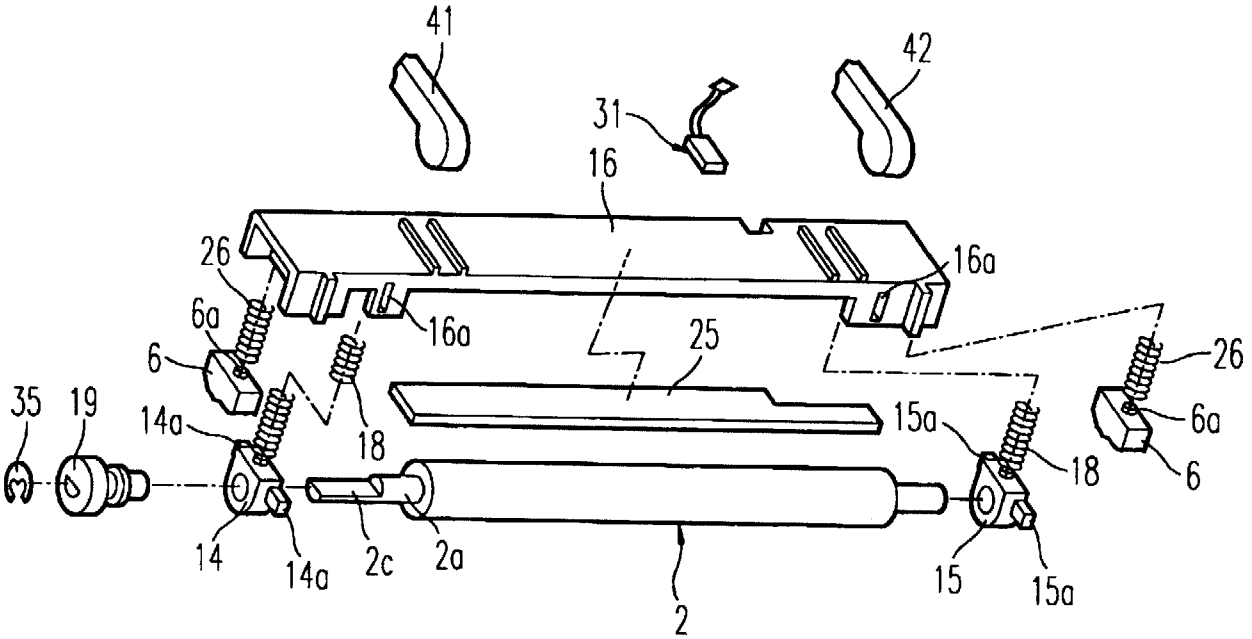
FIG. 4 is an exploded view illustrating a construction of the charging roller and the periphery thereof.

A charging unit is integrally formed as an unit, as illustrated in FIGS. 3 and 4, including the charging roller 2, bearings 14 and 15 which hold the charging roller 2, pressuring springs 18 which press the bearings 14 and 15, a charging roller driving gear 19, a cleaning pad 25 which is a cleaning member for cleaning the surface of the charging roller 2, an electrode 22 and a charging roller case 16 which is a charging roller support member to which the cleaning member is fixed and with which the charging roller 2 is engaged.

The charging roller 2 is made of a metal shaft **2*a* and a conductive raw rubber 2*b* (an epichlorohydrin rubber, for example) which is mounted around the metal shaft 2*a*, and charges the surface of the photoreceptor 9 uniformly by applying electricity of high voltage to the metal shaft 2*a* when the surface of the conductive raw rubber 2*b* is in contact with the surface of the photoreceptor 9**.

Both ends of the metal shaft **2*a* of the charging roller 2 are rotatably held by bearings 14 and 15 respectively. Projections 14*a* are formed on left side and right side surfaces of the bearings 14, extending to the left and right respectively, and likewise projections 15*a* are formed on left side and right side surfaces of the bearing 15, extending to the left and right respectively. These projections 14*a* and 15*a* are inserted to guide slots 16*a* which are provided in the charging roller case 16 at positions corresponding to the projections 14*a* and 15*a* respectively, in such a way that the bearings 14 and 15** are movable upward and downward.

Between the bearing 14 and the inner surface **16*c* of the charging roller case 16 is provided, as shown in FIG. 3, a pressuring spring 18, which presses, through the bearing 14, the charging roller 2 toward the photoreceptor 9** with a prescribed pressuring force.

The electrode 22 contacts an electrode of a receptacle (not shown in the drawing), which is provided in the main body of the apparatus, when the charging unit is mounted in a prescribed position of the main body of the apparatus, and an electric voltage is applied to the electrode 22 from an electric source with high voltage (not shown in the drawing) when the electrode 22 is in contact with the electrode of the receptacle of the main body of the apparatus. The electrode 22 is electrically connected with the bearing 15 through the pressuring spring 18 which presses the charging roller 2 toward the photoreceptor 9. Since the bearing 15 is made of a conductive material, the electrical voltage from the electric source with high voltage is applied to the charging roller 2.

An outer part of the metal shaft **2*a* of the charging roller 2 is cut off, toward one end, forming a flat surface on one side, to make a part of the metal shaft 2*a* toward such a side end to a D-shaped shaft 2*c* having a D-shaped cross sectional view as shown in FIG. 4. The D-shaped shaft 2*c* is inserted into a slot, which is formed in the center of a charging roller driving gear 19 in a shape corresponding to the D-shaped shaft 2*c*, and is fastened therein by an E ring 35 so that the charging roller driving gear 19 will not fall off the D-shaped shaft 2*c***.

The charging roller driving gear 19 engages with a photoreceptor front side gear 21 which is provided on the surface of a front part of the photoreceptor 9, on which a photoconductive material is not provided, when the charging roller 2 is in contact with the photoreceptor 9. Both ends of the photoreceptor 9 are rotatably held by a front frame and a rear frame of the image forming unit case 6.

Therefore, when the photoreceptor 9 rotates in the direction indicated by an arrow A, the charging roller driving gear 19 is rotated in the direction indicated by an arrow B by the photoreceptor front side gear 21 which rotates in the same direction as the photoreceptor 9, thus rotating the charging roller 2 compulsorily in the direction indicated by the arrow B.

To the inner surface **16*c* of the charging roller case 16 is stuck, by adhesives, such as a both sides adhesive tape, a cleaning pad 25 for cleaning the surface of the charging roller 2**.

Therefore, although the surface of the charging roller 2 which is continuously in contact with the surface of the photoreceptor 9 when the charging roller 2 is in a charging operation, can be easily contaminated by a minute toner which is transferred thereupon from the surface of the photoreceptor 9, the toner stuck on the surface of the charging roller 2 is removed by pressing the cleaning pad 25 to the surface of the charging roller 2, thus eliminating an occurrence of an uneven charge on the photoreceptor 9 which is caused by such contamination of the surface of the charging roller 2.

Further, upwardly pressuring springs 26 are provided between longitudinal end parts of the inner surface **16*c* of the charging roller case 16 and spring seats 6*a* (refer to FIG. 4) which are formed on edge surfaces of the front and rear frames of the image forming unit case 6, and the charging roller case 16 is pressed upward (see FIG. 3) by the pressuring force of the upwardly pressuring springs 26**.

For mounting the charging roller 2, which is integrated with other elements into a unit as described earlier, to the image forming unit case 6, end parts of side plates **16*d* and 16*e* of the charging roller case 16 are inserted into grooves 6*b* and 6*c* which are formed in the front and rear frames of the image forming unit case 6 at positions corresponding to the side plates 16*d* and 16*e* of the charging roller case 16**.

Since the charging roller case 16 is pressed upward by the upwardly pressuring springs 26, a stopper is needed to hold from above the charging roller case 16 in a prescribed position which is suitable for charging.

Figure 5:
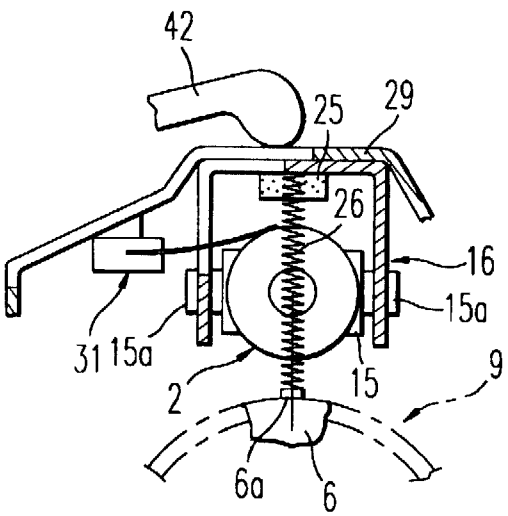
FIG. 5 is a schematic drawing illustrating an upper cover for regulating an upward distance of the charging roller.

In this embodiment, therefore, there is provided an upper cover 29 which functions as such a stopper, as shown in FIG. 5, and the upper cover 29 regulates an upward (see FIG. 5) distance of the charging roller 2 which moves together with the charging roller case 16 (refer to FIG. 2 also). Therefore, there is no need for providing a stopper mechanism for preventing the charging roller case 16 from coming off upwardly from the image forming unit case 6. Further, the upper cover 29 functions as a device for preventing an operator or a service man from touching the photoreceptor 9 or the charging roller 2.

The upper cover 29 is fastened to the image forming unit case 6 by inserting a fastening device, such as a fastening catch, which is provided in the image forming unit case 6, into a dent which is formed in the upper cover 29 at a position corresponding to the fastening catch. Therefore, the upper cover 29 can be mounted to and removed from the image forming unit case 6 by hand without using any tool. Accordingly, the charging roller 2 can be taken out, for replacement, for example, from the image forming unit case 6, together with the charging roller case 16 and the upper cover 29, by hand without using any tool.

The charging roller case 16, being engaged with the image forming unit case 6 by insertion of the side plates **16*d* and 16*e* into the grooves 6*b* and 6*c* which are formed in the front and rear frames of the image forming unit case 6, as shown in FIG. 3, can be taken out from the image forming unit case 6** by simply lifting upward.

Further, the upwardly pressuring springs 26 are prevented from falling off from the image forming unit case 6, when the charging roller 2 is taken off from the image forming unit case 6 integrally with the other elements, by providing a convexity in the spring seat **6*a* which is provided in the image forming unit case 6 or in the inner surface 16*c* of the charging roller case 16 and inserting the upwardly pressuring springs 26** therein.

Next, a charging roller moving device 30 for moving the charging roller 2 towards and away from the photoreceptor 9 and the cleaning pad 25, and a controller 50 for controlling the charging roller moving device 30 are explained.

Generally, if a conductive rubber part of a charging roller is kept in contact with the same part of a photoreceptor for a long time without performing an image forming operation, plastic materials which are contained in the rubber part of the charging roller ooze out and contaminate the surface of the photoreceptor which is in contact with the charging roller, consequently causing an irregular reproduction of an image. Therefore, when the charging roller and the photoreceptor are left unoperated for a long time, it is desirable to separate the charging roller from the photoreceptor.

In this embodiment, therefore, there is provided a charging roller moving device 30 for moving the charging roller 2 towards and away from the photoreceptor 9 and the cleaning pad 25 to positions including a first position where the charging roller 2 is separated from the cleaning pad 25 and is in contact with the photoreceptor 9 for charging the photoreceptor 9, a second position where the charging roller 2 is in contact with the cleaning pad 25 for cleaning the surface of the charging roller 2 and a third position where the charging roller 2 is separated from the photoreceptor 9 and the cleaning pad 25.

First, the charging roller moving device 30 for moving the charging roller 2 towards and away from the photoreceptor 9 and the cleaning pad 25 is explained.

In FIG. 3, a first pressuring arm 41 and a second pressuring arm 42 are lever members which pivot around an arm support axis 43 and press the charging roller 2 towards the photoreceptor 9 by pressing the upper surface of the charging roller case 16 on each end part.

The first pressuring arm 41 and the second pressuring arm 42 are fixed on the arm support axis 43, leaving a space in between and extending in the same direction, and both ends of the arm support axis 43 are rotatably held via a bearing or the like by a front side plate 23 and a rear side plate 24 of the main body of the image forming apparatus.

Therefore, when the arm support axis 43 rotates clockwise or counterclockwise in FIG. 3, the first pressuring arm 41 and the second pressuring arm 42 are rotated together in the same direction the same amount of the rotation.

The second pressuring arm 42 includes, at the end part which is opposite to the end part engaging with the charging roller case 16, a cam engaging part **42*a*, and the bottom surface of the cam engaging part 42*a* is in contact with a charging roller moving cam 44 which has an eccentric shape as shown in FIG. 1. And, an arm pressuring spring 47 is provided between the upper surface of the cam engaging part 42*a* of the second pressuring arm 42 and a spring holder 46 which is fixed on the main body of the apparatus, and the cam engaging part 42*a* is pressed towards and in contact with the charging roller moving cam 44 by a pressing force of the arm pressuring spring 47**.

When the charging roller moving cam 44 rotates, the second pressuring arm 42 moves in the direction indicated by an arrow C a distance which is regulated in accordance with a distance Lc, which is a distance from a point where the charging roller moving cam 44 contacts the second pressuring arm 42 to the center of an axis 45 which integrally supports the charging roller moving cam 44. As the shape of the charging roller moving cam 44 is eccentric, the distance Lc varies as the charging roller moving cam 44 rotates, and the second pressuring arm 42 moves in accordance with the distance Lc. The first pressuring arm 41 which is fixed to the arm holding axis 43, as shown in FIG. 3, moves the same distance in the same direction as the second pressuring arm 42. Therefore, the charging roller case 16 moves upward and downward as the first and second pressuring arms 41 and 42 move. Thus, the charging roller moving cam 44, being engaged with the second pressuring arm 42, regulates the stopping positions of the second pressuring arm 42.

Figure 6:
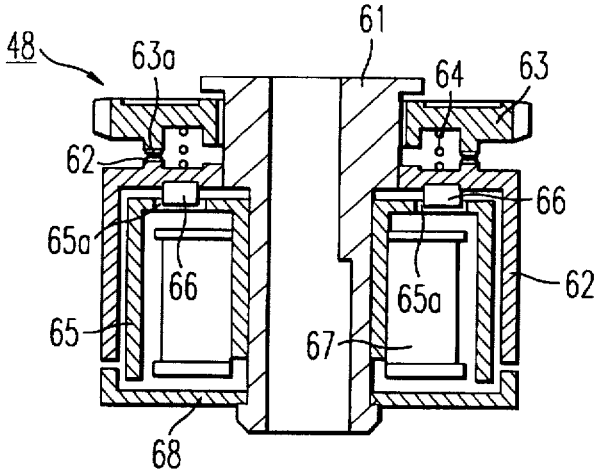
FIG. 6 is a schematic drawing illustrating a construction of an electromagnetic spring clutch for driving a charging roller moving device.

The charging roller moving cam 44 is connected, via the axis 45, to a revolving axis of an electromagnetic spring clutch 48 which rotates 120 degrees in one operation as shown in FIG. 2. The electromagnetic spring clutch 48 functions as a device for driving the charging roller moving cam 44 and is a conventional magnetic clutch, as shown in FIG. 6, which rotates 120 degrees each time.

The electromagnetic spring clutch 48 includes a rotor 62 which is not rotatable relatively to and is mounted on a revolving axis 61 in such a way that the rotor 62 moves only in a direction parallel to the revolving axis 61, and a gear 63 is mounted, rotatably on the revolving axis 61, next to the rotor 62 in a direction parallel to the revolving axis 61, adjoining each other. The rotor 62 and the gear 63 respectively include on each surface, which face each other, teeth **62*a* and 63*a* which engage each other, and the rotor 62 is rotated together with the revolving axis 61 by the gear 63 when the teeth 62*a* and the teeth 63*a*** are engaged.

A spring 64 is provided between the rotor 62 and the gear 63, and the gear 63 is usually separated from the rotor 62 by the pressuring force of the spring 64, enabling the gear 63 running idle relative to the revolving axis 61.

The rotor 62 includes a yoke 65 in the inside, and three holes **65*a* are provided on the yoke 65 at intervals of 120 degrees in the revolving direction of the rotor 62, and three pins 66 are provided on the rotor 62 correspondingly to the holes 65*a*. Further, the pins 66 are inserted into the holes 65*a* by the pressuring force of the spring 64**.

The rotor 62 is moved towards the gear 63 by an armature 68 which moves when a coil 67 is magnetized, and the pins 66 come out of the holes 65*a* when the rotor 62 is moved toward the gear 63. Then, the teeth 62*a* of the rotor 62 engage with the teeth 63*a* of the gear 63, and the rotor 62 is rotated together with the revolving axis 61.

When the magnetization to the coil 67 is discontinued, the rotor 62 rotates with the end part of the pin 66 being pressed, by the pressuring force of the spring 64, to the surface of the yoke 65 from the hole 65*a* to the next hole 65*a* neighboring at an interval of 120 degrees, and, when rotated 120 degrees, the pin 66 slips into the next hole 65*a* and the rotor 62 moves downward in FIG. 6, thereby releasing the engagement of the teeth 63*a* of the gear 63 and the teeth 62*a* of the rotor 62 and stopping the revolution of the rotor 62.

As described above, the revolving axis 61 of the electromagnetic spring clutch 48 rotates 120 degrees each time. Therefore, the charging roller moving cam 44 which is shown in FIG. 2 is rotated 120 degrees each time by the electromagnetic spring clutch 48 and is stopped at the position selected from the three positions while making one revolution. Thus, the position to which the charging roller case 16 is pressed downward by the first and second pressuring arms 41 and 42 is selected.

Figure 7:
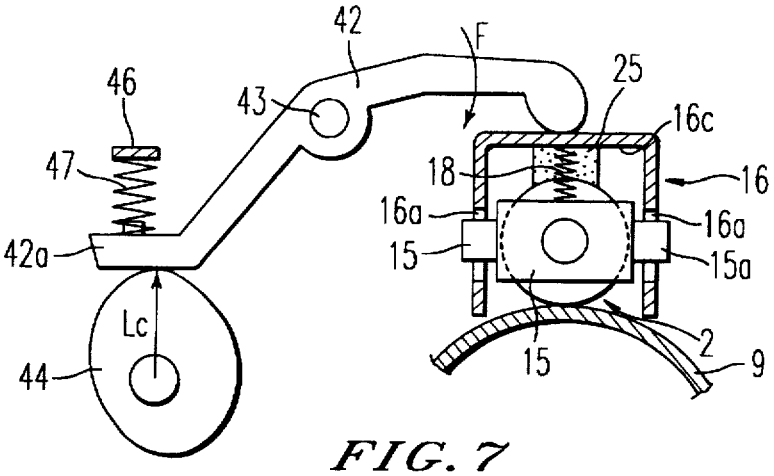
FIG. 7 is a schematic drawing illustrating a state where the charging roller is in contact with the photoreceptor and the cleaning member for the charging roller.
Figure 8:
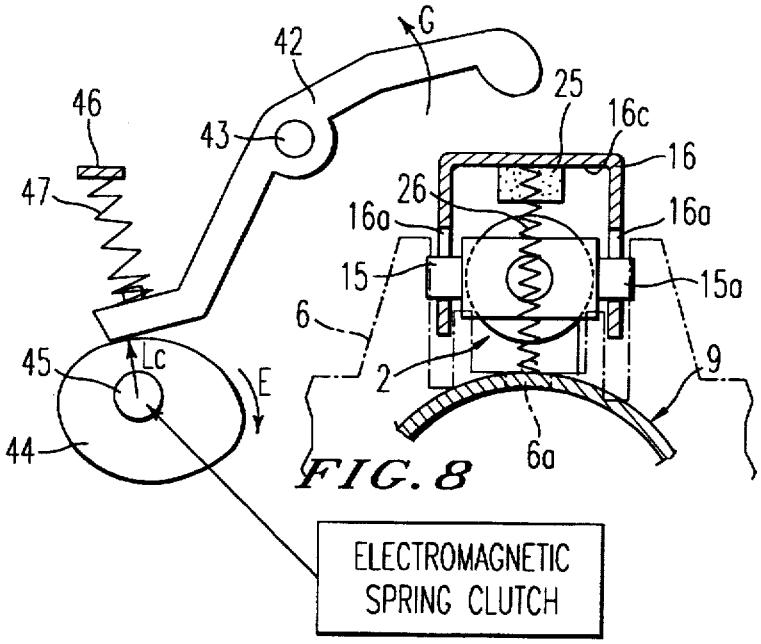
FIG. 8 is a schematic drawing illustrating a state where the charging roller is separated from the photoreceptor and the cleaning member for the charging roller.

The above-mentioned three positions are the first position where the cleaning pad 25 is separated from the surface of the charging roller 2 and the charging roller 2 is contacted with the photoreceptor 9, thereby enabling the charging of the surface of the photoreceptor 9, as shown in FIG. 1, the second position where the cleaning pad 25 is pressed toward and is in contact with the surface of the charging roller 2, thereby enabling the cleaning of the surface of the charging roller 2, as shown in FIG. 7, and the third position where the charging roller 2 is separated from the photoreceptor 9 and the cleaning pad 2, as shown in FIG. 8.

Moreover, the shape of the charging roller moving cam 44 is so made such that the distance Lc of the charging roller moving cam 44 becomes such a distance based on which one of the first, second and third positions is selected.

In the above-mentioned embodiment, an electromagnetic spring clutch 48 is employed as a device for driving the charging roller moving cam 44 to rotate 120 degrees each time. However, a stepping motor can be used instead. In such a case, the revolving axis is connected to the axis 45 and the stepping motor is rotated by a number of steps which is required for rotating the axis 45 120 degrees each time.

As described earlier, a controller 50 controls the charging roller moving device 30 in such a way that the charging roller 2 is placed in one of the above-mentioned three positions.

The controller 50 (shown in FIG. 1) for controlling the charging roller moving device 30 may be a micro computer which includes a central processing unit (CPU) which performs various judgments and processings, a ROM which stores various programs, including programs for controlling the charging roller moving device 30, and various fixed data, a RAM for storing various processing data, and an input and output circuit.

The controller 50 receives various signals from a thermistor 31 (shown in FIG. 5) and sensors which are provided at various parts of the apparatus for performing an image forming operation in a prescribed manner, various signals for designating various conditions for an image forming operation, which are prescribed by an operator, and various other signals, such as a signal for starting an image forming operation or the like, and then outputs to various driving devices and elements which are driven various signals for driving the driving device at a prescribed timing, and further outputs a signal for activating the electromagnetic spring clutch 48 to a driving circuit 51.

Next, operations of the charging roller moving device 30, which are controlled by the controller 50, are explained in details with respect to each operation for charging the photoreceptor 9, cleaning the surface of the charging roller 2 and separating the charging roller 2 from the photoreceptor 9 and the cleaning pad 25.

First, an operation for charging the photoreceptor 9 is explained.

As described earlier, when the apparatus is in a state where all of the operations including an image forming operation are discontinued, the charging roller 2 is in a state of being separated from the surface of the photoreceptor 9 and the cleaning pad 25, the charging roller case 16 being pressed upward by the pressuring force of the pressuring spring 26 as shown in FIG. 8.

If a copy start copy button is depressed in such a state, the controller 50 sends to the driving circuit 51 (refer to FIG. 1), almost at the same time as the copy start button is depressed or after a prescribed period of time is passed after the depression of the copy start button, an ON signal to activate and drive the electromagnetic spring clutch 48, thereby rotating the charging roller moving cam 44, via the axis 45, 120 degrees in the direction indicated by an arrow E. Also, the controller 50 rotates the photoreceptor 9 counterclockwise in FIG. 8 almost at the same as the copy start button is depressed or after a prescribed period of time is passed after the depression of the copy start button.

Accordingly, the charging roller moving cam 44 rotates 120 degrees to the position shown in FIG. 1 from the position shown in FIG. 8. Since a part of the charging roller moving cam 44, whose distance Lc is longer than that of a part which is in contact with the cam contacting part 42*a* in FIG. 8, becomes in contact with the cam contacting part 42*a* of the second pressuring arm 42, the second pressuring arm 42 moves in the direction indicated by an arrow F in FIG. 1 pivoting on the arm holding axis 43. At the same time, the first pressuring arm 41, being integrally made with the second pressuring arm 42 via the arm holding axis 43, as shown in FIG. 3, moves the same distance as the second pressuring arm 42 also in the direction indicated by the arrow F. Accordingly, the charging roller case 16 is pressed downward by the end parts of the first and second pressuring arms 41 and 42, and consequently, the charging roller 2 is pressed toward, by a constant pressuring force of the front and rear pressuring springs 18, via the front and rear bearings 14 and 15, and to be in contact with the photoreceptor 9.

Further, while the charging roller 2 is in contact with the surface of the photoreceptor 9, a charging operation is performed by applying an electric voltage for charging to the charging roller 2 from an electric source with high voltage at a certain timing, and the surface of the photoreceptor 9 is uniformly charged accordingly.

During the charging operation, the charging roller driving gear 19 and the photoreceptor front side gear 21 provided on the front side of the photoreceptor 9, which are illustrated in FIG. 3, are engaged with each other, and therefore, the charging roller 2 is rotated compulsorily by the rotation of the photoreceptor 9 in the direction indicated by an arrow B.

Therefore, although there exists a problem, in a case that the charging roller 2 is rotated only by the friction force between the charging roller 2 and the photoreceptor 9, that a slippage may occur between the charging roller 2 and the photoreceptor, thereby causing a deterioration of a charging characteristics on a part where the slippage occurs, such a problem is prevented from occurring in the embodiment of the present invention.

Next, an operation of cleaning the surface of the charging roller 2 is explained.

The controller 50, after detecting that the tailing end of a copy sheet in a case of a single copying, or the tailing end of the last copy sheet in a case of a multiple copying, has passed through a transfer area (an area where the photoreceptor 9 and the transfer roller 8 come in contact with each other in FIG. 2), sends to the driving circuit 51 an ON signal for activating the electromagnetic spring clutch 48, and drives the electromagnetic spring clutch 48 to rotate the charging roller moving cam 44 120 degrees from the position shown in FIG. 1, which is a position for a charging operation, in the direction indicated by an arrow E until the charging roller moving cam 44 comes to the position shown in FIG. 7.

Since the charging roller moving cam 44 comes to a position where a part thereof, whose distance Lc is larger than that of a part of the charging roller moving cam 44 which is in contact with the cam contacting part 42*a* of the second pressuring arm 42 in FIG. 1, comes in contact with the cam contacting part 42*a*, the second pressuring arm 42 moves in the direction indicated by an arrow F, pivoting on the arm holding axis 43, and the first pressuring arm 41 also moves the same distance as the second pressuring arm 42 also in the direction indicated by the arrow F.

The charging roller case 16 is pressed downward accordingly by the first and second pressuring arms 41 and 42, and moves a certain distance, corresponding to the change in the distance Lc, from the position shown in FIG. 1, and consequently, the cleaning pad 25 is pressed toward and comes in contact with the charging roller 2 as shown in FIG. 7.

The charging roller 2 then rotates for a prescribed period of time (cleaning time), and the surface of the charging roller 2 is cleaned by the cleaning pad 25. During such a cleaning operation, the charging roller driving gear 19 and the photoreceptor front side gear 21 provided on the front side of the photoreceptor 9 (shown in FIG. 3) are engaged, and the revolving force of the photoreceptor 9 is compulsorily conveyed to the charging roller 2.

Therefore, although there exists a problem, in a case that the charging roller 2 is rotated by a friction between the charging roller 2 and the photoreceptor 9 and the cleaning pad 25 is pressed toward and is in contact with the surface of the charging roller 2, that the charging roller 2 becomes unable to rotate due to a burden from the cleaning pad 25, such a problem is prevented from occurring in this embodiment since the revolving force is compulsorily given to the charging roller 2 as described above.

Next, an operation for separating the charging roller 2 from the photoreceptor 9 and the cleaning pad 25 is explained.

The controller 50, after completing the cleaning operation for the charging roller 2, sends to the driving circuit 51 an ON signal for activating the electromagnetic spring clutch 48 and drives the charging roller moving cam 44 120 degrees in the direction indicated by an arrow E in FIG. 8 from the position shown in FIG. 7.

Since the charging roller moving cam 44 comes to a position where a part thereof, whose distance Lc is shorter than that of a part of the charging roller moving cam 44 which is in contact with the cam contacting part 42*a* of the second pressuring arm 42 in FIG. 1, comes in contact with the cam contacting part 42*a*, the second pressuring arm 42 moves in the direction indicated by an arrow G, pivoting on the arm holding axis 43, and the first pressuring arm 41 also moves the same distance in the same direction as the second pressuring arm 42.

Since parts of the first and second pressuring arms 41 and 42 which contact the upper surface of the charging roller case 16 move upward in FIG. 8, the charging roller case 16 is pressed upward by the pressuring force of the upwardly pressuring springs 26 on both sides.

Accordingly, the charging roller 2 which is mounted to the charging roller case 16 via the bearings 14 and 15 is moved upward and is separated from the photoreceptor 9 as shown in FIG. 8.

In the above-mentioned embodiment, the electromagnetic spring clutch 48, the charging roller moving cam 44, the first and second pressuring arms 41 and 42, the charging roller case 16 and so forth act as a structure which enables a movement of the cleaning member, which is the cleaning pad 25, towards and away from the charging roller 2 independently from a movement of the charging roller 2 towards and away from the photoreceptor 9.

Further, the electromagnetic spring clutch 48, the charging roller moving cam 44, the first and second pressuring arms 41 and 42 and the upwardly pressuring spring 26 act as a device for moving the charging roller support member, which is the charging roller case 16, towards and away from the surface of the photoreceptor 9.

Further, the electromagnetic spring clutch 48, the charging roller moving cam 44 and the first and second pressuring arms 41 and 42 act as a device for pressing the charging roller case 16 towards the photoreceptor 9 with a pressing force which is stronger than that of the upwardly pressuring spring 26.

While there is described in the above-mentioned embodiment a charging roller moving device in which a cleaning member for the charging roller is also moved, an example of a charging roller moving device wherein only the charging roller is moved is explained next.

Figure 9:
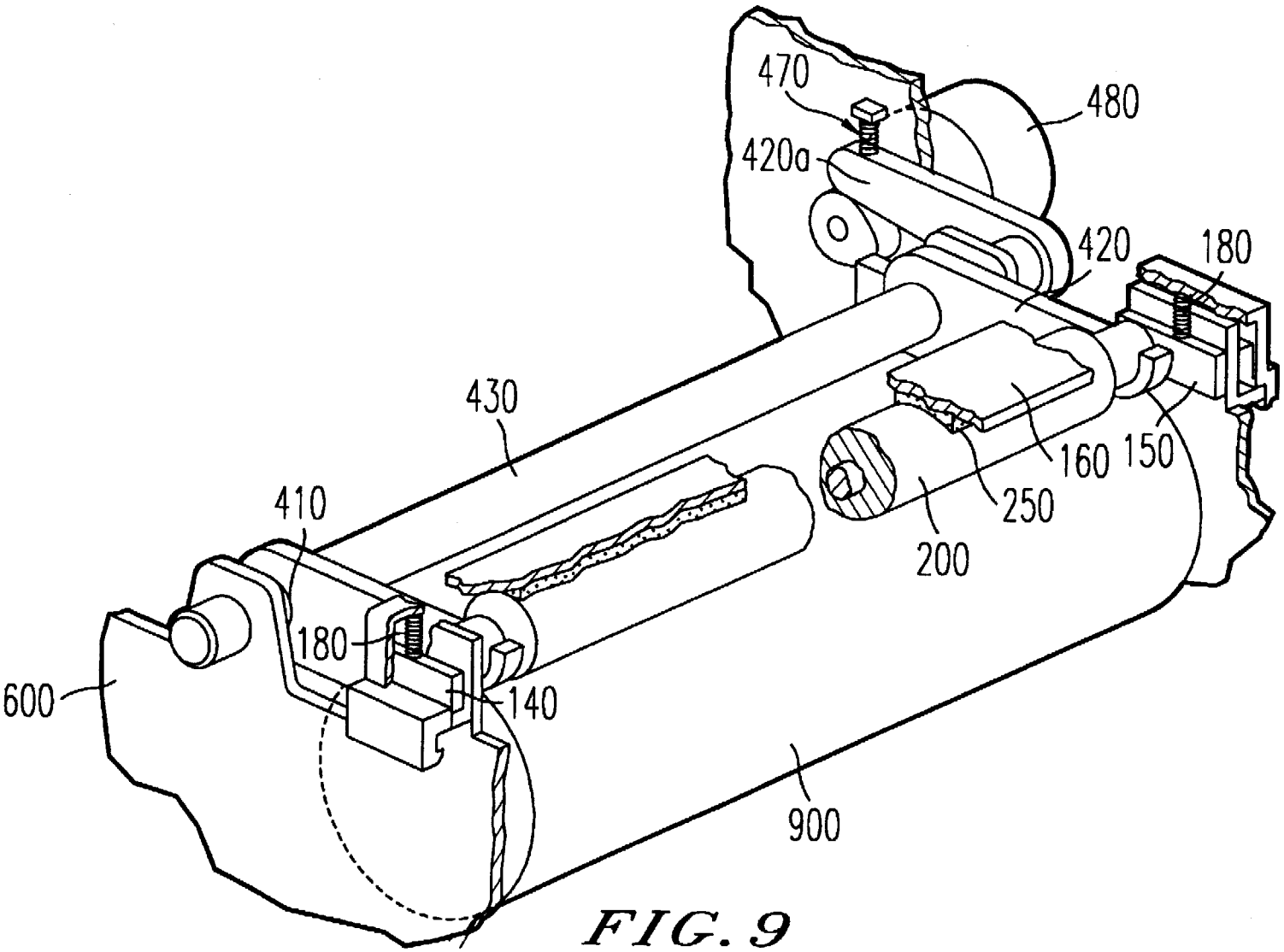
FIG. 9 is a perspective drawing illustrating a charging roller and the periphery thereof in a second embodiment of the present invention.

In FIG. 9, a charging roller 200 is held movably upward and downward by an image forming unit case 600 via bearings 140 and 150. A cleaning pad case 160 to which a cleaning pad 250 is fixed is provided above the charging roller 200. The cleaning pad case 160 is fastened to the image forming unit case 600 by a fastening device. The charging roller 200 is always pressed downward, together with the bearings 140 and 150, by pressuring springs 180, whose ends which are not in contact with the charging roller 200 are fixed to the cleaning pad case 160. Both end parts of the charging roller 200 are held by end parts of the charging roller moving arms 410 and 420, and the other end parts of the charging roller moving arms 410 and 420 are fixed to an arm holding axis 430, which is rotatably held by the image forming unit case 600.

To the rear side end of the arm holding axis 430 is fixed a driving arm 420*a*, which moves upward and downward in accordance with the shape of a charging roller moving cam 440. Such upward and downward movement of the driving arm 420*a* is conveyed to the charging roller moving arms 410 and 420 as reversed upward and downward movements pivoting on the arm holding axis 430. The driving arm 420*a* is always pressed toward and in contact with the charging roller moving cam 440 by an arm pressuring spring 470. The charging roller moving cam 440, being directly connected with an electromagnetic spring clutch 480, rotates accordingly upon receiving a signal for a prescribed mode and stops at a prescribed position.

Figure 10:
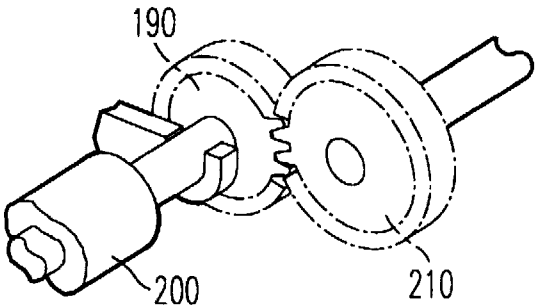
FIG. 10 is a schematic drawing illustrating a charging roller driving gear engaging with a main body driving gear in the second embodiment.

When the charging roller 200 is in a position of contacting the cleaning pad 250, a charging roller driving gear 190 engages with a main body driving gear 210, as shown in FIG. 10, and the charging roller 200 is rotated by a driving force from the main body via such gears, thus enabling a cleaning of the surface of the charging roller 200 by the cleaning pad 250.

Figure 11C:
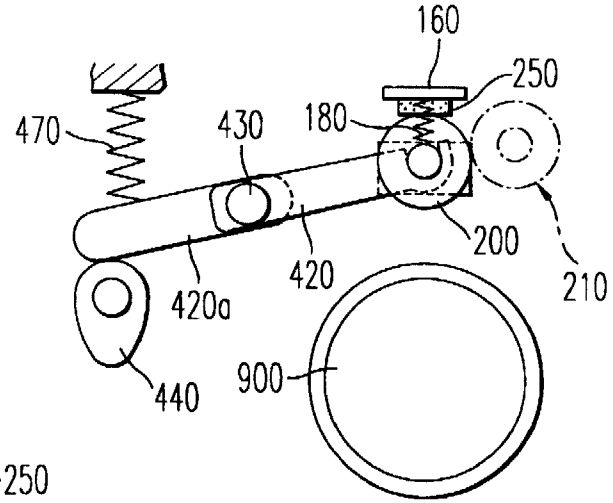
FIG. 11(*a*) is a schematic drawing illustrating a state where the charging roller is separated from the photoreceptor and the cleaning member for the charging roller in the second embodiment.
Figure 11B:
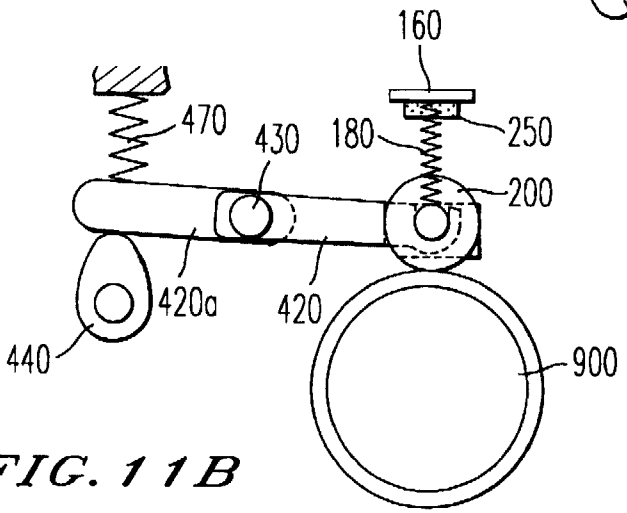
Figure 11A:
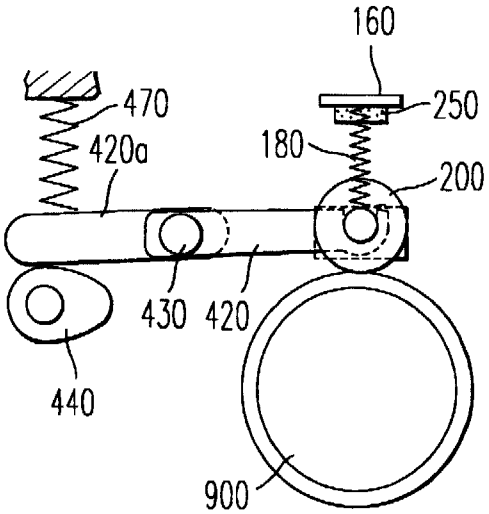

Next, an operation of the charging roller 200 is explained referring to FIGS. 11(*a*)–11(*c*).

When the image forming apparatus is not in operation, the charging roller 200 is in a position separated from a photoreceptor 900 and the cleaning pad 250 as shown in FIG. 11(*a*). When a charging operation is commenced, the electromagnetic spring clutch 480 starts rotating and stops after rotating a prescribed amount at a position where the charging roller moving cam 440 places the driving arm 420*a* at the uppermost position as shown in FIG. 11(*b*). At the same time, the charging roller moving arms 420 and 410 move downward pivoting on the arm holding axis 430 and the charging roller 200 is pressed downward, by the pressuring force of the pressuring springs 180, to contact the surface of the photoreceptor 900, thereby enabling a charging operation on the surface of the photoreceptor 900. When an operation for cleaning the surface of the charging roller 200 is commenced, the electromagnetic spring clutch 480 stops, after rotating a prescribed amount, at a position where the charging roller moving cam 440 places the driving arm 420*a*, which is pressed downward by the arm pressuring spring 470, at the lowermost position, thereby moving the charging roller moving arms 410 and 420 upward, thus pressing the charging roller 200 towards and to be in contact with the cleaning pad 250 as shown in FIG. 11(*c*). The charging roller driving gear 190 of the charging roller 200 engages with the main body driving gear 210, as shown in FIG. 10, when the charging roller 200 is in this position, and the charging roller 200 is rotated by a driving force from the main body of the apparatus. After the cleaning operation is completed, the electromagnetic spring clutch 480 rotates again and stops at the position shown in FIG. 11(*a*).

Obviously, numerous additional modifications and variations of the present invention are possible in light of the above teachings. It is therefore to be understood that within the scope of the appended claims, the present invention may be practiced otherwise than as specifically described herein.

What is claimed as new and desired to be secured by Letters Patent of the United States is:

1. An image forming apparatus, comprising:

a photoreceptor;

a charging roller;

a cleaning member for cleaning a surface of the charging roller;

a developing unit;

a cleaning unit for cleaning a surface of the photoreceptor;

a charging roller moving device for moving the charging roller towards and away from the photoreceptor and the cleaning member to positions including:

a first position where the charging roller is separated from the cleaning member and is in contact with the photoreceptor for charging the photoreceptor;

a second position where the charging roller is in contact with the cleaning member for cleaning the surface of the charging roller; and a third position where the charging roller is separated from the photoreceptor and the cleaning member.

2. The image forming apparatus according to claim 1, wherein the charging roller is in contact with the photoreceptor when the charging roller is in said second position.

3. The image forming apparatus according to either one of claims 1 or 2, wherein said charging roller moving device comprises a structure which enables a movement of the cleaning member towards and away from the charging roller independently from a movement of the charging roller towards and away from the photoreceptor.

4. An image forming apparatus comprising:

a photoreceptor;

a charging roller;

a cleaning member for cleaning a surface of the charging roller;

a developing unit;

a cleaning unit for cleaning a surface of the photoreceptor;

a charging roller moving device for moving the charging roller towards and away from the photoreceptor and the cleaning member to positions including:

a first position where the charging roller is separated from the cleaning member and is in contact with the photoreceptor for charging the photoreceptor;

a second position where the charging roller is in contact with the cleaning member for cleaning the surface of the charging roller; and a third position where the charging roller is separated from the photoreceptor and the cleaning member;

wherein the charging roller is in contact with the photoreceptor when the charging roller is in said second position;

wherein said charging roller moving device comprises a structure which enables a movement of the cleaning member towards and away from the charging roller independently from a movement of the charging roller towards and away from the photoreceptor and wherein said structure comprises:

a charging roller support member to which the cleaning member is fixed and with which the charging roller is engaged in a manner movable towards and away from the cleaning member; and a device for moving said charging roller support member towards and away from the photoreceptor.

5. The image forming apparatus according to claim 4, wherein said device for moving the charging roller support member towards and away from the photoreceptor comprises:

a spring member for pushing said charging roller support member away from the photoreceptor; and a device for pressing said charging roller support member towards the photoreceptor, said device for pressing the charging roller support member having a pressing force which is stronger than that of said spring member and comprising a device for placing said charging roller support member at positions including said first, second and third positions.

6. The image forming apparatus according to claim 5, wherein said device for placing the charging roller support member to positions including said first, second and third positions comprises:

a lever member for pressing the charging roller support member towards the photoreceptor; and a cam member which is engaged with said lever member and for prescribing positions to place the charging roller support member including said first, second and third positions.

7. The image forming apparatus according to claim 5, wherein a part of said device for pressing the charging roller support member, which contacts and presses the charging roller support member, is located at a position separated from the charging roller support member when the charging roller support member is located in said third position.

8. The image forming apparatus according to claim 4, wherein said photoreceptor includes a gear on first and second edges and said charging roller is provided with respective gears at positions corresponding to said gears on the photoreceptor, and said gears on the charging roller engage with said gears on the photoreceptor when the charging roller is located in said second position and is in contact with the photoreceptor.

9. The image forming apparatus according to claim 4, further comprising a case for housing therein said charging roller support member and photoreceptor, said case being detachable from the image forming apparatus.

10. The image forming apparatus according to claim 4, further comprising a case for housing therein said charging roller support member, developing unit and cleaning unit, said case being detachable from the image forming apparatus.

11. The image forming apparatus according to claim 9, wherein said device for moving the charging roller support member towards and away from the photoreceptor is mounted to a main body of the apparatus.

12. The image forming apparatus according to claim 10, wherein said device for moving the charging roller support member towards and away from the photoreceptor is mounted to a main body of the apparatus.

13. An image forming apparatus, comprising:

a photoreceptor;

a charging roller;

a cleaning member for cleaning a surface of the charging roller;

a charging roller moving device for moving said charging roller towards and away from the photoreceptor and the cleaning member; and a controller for controlling the charging roller moving device so as to separate the charging roller from the photoreceptor except when the charging roller charges the photoreceptor and except when the charging roller is cleaned by the cleaning member.

14. An image forming apparatus comprising:

a photoreceptor;

a charging roller;

a cleaning member for cleaning a surface of the charging roller;

a charging roller moving device for moving said charging roller towards and away from the photoreceptor and the cleaning member; and a controller for controlling the charging roller moving device to move the charging roller to a first position where the charging roller contacts the photoreceptor and does not contact the cleaning member, and to a second position where the charging roller contacts the cleaning member and does not contact the photoreceptor;

wherein the controller controls the charging roller moving device to move the charging roller to be stopped in a third position where the charging roller contacts neither of the photoreceptor nor the cleaning member.

15. An image forming apparatus, comprising:

a photoreceptor;

a charging roller;

a cleaning member for cleaning a surface of the charging roller; and a device for moving the charging roller and the cleaning member to be stopped in a position where the charging roller is separated from both the photoreceptor and the cleaning member.

16. An image forming apparatus, comprising:

a photoreceptor;

a charging roller;

a cleaning member for cleaning a surface of the charging roller;

a charging roller moving device for moving the charging roller towards and away from the photoreceptor and the cleaning member to be stopped in positions including:

a first position where the charging roller is separated from the cleaning member and is in contact with the photoreceptor for charging the photoreceptor;

a second position where the charging roller is in contact with the cleaning member for cleaning the surface of the charging roller; and a third position where the charging roller is separated from the photoreceptor and the cleaning member.

* * * * *